US008652012B2

(12) United States Patent
Smith

(10) Patent No.: US 8,652,012 B2
(45) Date of Patent: Feb. 18, 2014

(54) COLOR CHANGING GYROSCOPIC EXERCISER

(76) Inventor: Tom Smith, Yorba Linda, CA (US)

( * ) Notice: Subject to any disclaimer, the term of this patent is extended or adjusted under 35 U.S.C. 154(b) by 397 days.

(21) Appl. No.: 13/178,082

(22) Filed: Jul. 7, 2011

(65) Prior Publication Data

US 2013/0012361 A1 Jan. 10, 2013

(51) Int. Cl.

| | |
|---|---|
| ***A63B 23/00*** | (2006.01) |
| ***A63B 23/14*** | (2006.01) |
| ***A63B 23/16*** | (2006.01) |
| ***A63H 1/24*** | (2006.01) |

(52) U.S. Cl.
USPC ..... 482/44; 446/233

(58) Field of Classification Search
USPC ..... 362/23.08, 109, 458, 800; 482/1, 44; 446/233
See application file for complete search history.

(56) References Cited

U.S. PATENT DOCUMENTS

| | | | | |
|---|---|---|---|---|
| 4,150,580 | A * | 4/1979 | Silkebakken et al. | 74/5 R |
| 4,684,124 | A * | 8/1987 | Escher | 482/110 |
| 6,428,432 | B1 * | 8/2002 | Kachel | 473/570 |
| 6,770,012 | B2 * | 8/2004 | Kuo | 482/44 |
| 6,893,138 | B1 * | 5/2005 | Jones | 362/96 |
| 6,965,205 | B2 * | 11/2005 | Piepgras et al. | 315/318 |
| 7,101,315 | B2 * | 9/2006 | Chuang et al. | 482/44 |
| 7,102,258 | B2 * | 9/2006 | Shen | 310/50 |
| 7,566,142 | B2 * | 7/2009 | Wesson | 362/231 |
| 7,846,066 | B1 * | 12/2010 | Chuang | 482/1 |
| 7,935,035 | B2 * | 5/2011 | Smith | 482/110 |
| 2003/0139256 | A1 * | 7/2003 | Chuang et al. | 482/44 |
| 2005/0113214 | A1 * | 5/2005 | Chuang et al. | 482/44 |
| 2008/0242508 | A1 * | 10/2008 | Smith | 482/2 |
| 2009/0247375 | A1 * | 10/2009 | Smith | 482/110 |
| 2010/0048359 | A1 * | 2/2010 | Chuang et al. | 482/44 |
| 2011/0237367 | A1 * | 9/2011 | Kodama et al. | 473/570 |
| 2012/0077643 | A1 * | 3/2012 | Chuang et al. | 482/44 |

* cited by examiner

*Primary Examiner* — Loan Thanh
*Assistant Examiner* — Joshua Lee
(74) *Attorney, Agent, or Firm* — Clement Cheng

(57) ABSTRACT

A gyroscopic wrist exerciser has a transparent plastic housing and a gyroscopic rotor mounted on an axle rotating on a primary axis of rotation about the axle. Ends of the axle are extended into a circumferential housing groove disposed on an inside surface of the transparent plastic housing to rotate in a secondary axis of rotation about the circumferential groove to provide precession of the gyroscopic rotor. A permanent magnet cooperating with a coil produces an electric current proportional to the speed of the rotor. A microcontroller connected to and powered by the coil has three separate outputs, namely a first output, a second output and a third output which receive degrees of voltage depending upon an input voltage from the coil. A first LED chip, a second LED chip, and a third LED chip are connected to the microcontroller at the three outputs.

11 Claims, 5 Drawing Sheets

COLOR CHANGING GYROSCOPIC EXERCISER

FIELD OF THE INVENTION

The present invention is in the field of gyroscopic wrist exercisers.

DISCUSSION OF RELATED ART

The precession driven gyroscopic wrist exerciser was first invented by Archie L. Mishler and patented Apr. 10, 1973 in U.S. Pat. No. 3,726,146. For those unfamiliar with the gyroscopic wrist exerciser mechanism, the Mishler reference abstract provides an excellent primer regarding the kinematic physics. Jerrold W. Silkebakken further improved precessional stability adding a sectioned ring within the race patented Apr. 24, 1979 in U.S. Pat. No. 4,150,580.

Color changing gyroscopic wrist exercisers have been describing in U.S. Pat. No. 7,846,066 issued Dec. 7, 2010 to Chuang, the disclosure of which is incorporated herein by reference. Chuang teaches her light emitting control circuit and a wrist training ball using a light emitting device where the electricity generating circuit generates electric power by rotational kinetic energy of the wrist training ball and outputs the electric power to the light emitting control circuit. The light emitting control circuit is made by components not having a programmable controller. Chuang teaches that the color changing components can be mounted on a printed circuit board which is in turn mounted on the rotor.

SUMMARY OF THE INVENTION

A gyroscopic wrist exerciser has a transparent plastic housing and a gyroscopic rotor mounted on an axle rotating on a primary axis of rotation about the axle. Ends of the axle are extended into a circumferential housing groove disposed on an inside surface of the transparent plastic housing to rotate in a secondary axis of rotation about the circumferential groove to provide precession of the gyroscopic rotor. A permanent magnet cooperating with a coil produces an electric current proportional to the speed of the rotor. A microcontroller connected to and powered by the coil has three separate outputs, namely a first output, a second output and a third output which receive degrees of voltage depending upon an input voltage from the coil. A first LED chip, a second LED chip, and a third LED chip are connected to the microcontroller at the three outputs.

A first LED chip is connected to the microcontroller at the first output. A second LED chip is connected to the microcontroller at the second output. A third LED chip is connected to the microcontroller at the third output. The gyroscopic wrist exerciser optionally includes a translucent plastic grip. A rotor groove formed as a circumferential groove around an external periphery of the rotor, wherein the rotor groove further comprises an LED bulb mounting hole.

An LED bulb can be mounted within the LED bulb mounting hole, and the LED bulb includes a first LED chip, a second LED chip and a third LED chip encapsulated within the LED bulb. The first LED chip, the second LED chip and the third LED are formed in an LED chip package which is encapsulated within the LED bulb. The microcontroller is preferably encapsulated within the LED bulb at a base of the LED bulb. The groove lens has a groove lens body and a groove lens sidewall, and the groove lens caps the LED bulb mounting hole to present a substantially flush outer surface.

The microcontroller is configured to produce a varied output depending upon voltage input from the coil. At a minimum voltage the first chip activates producing a first LED maximum output, and the second LED chip begins at a second LED lower range shut off output, and the third LED chip begins at a third LED lower range shut off of no light intensity. An increase of rotational speed and voltage to a lower middle voltage range provides a drop in intensity of the first LED chip, and increasing the intensity of the second LED chip and a minor increase in the intensity of the third LED chip.

A middle voltage range produces a first LED lower output at the first LED chip, wherein the second LED chip proceeds to a second LED midrange maximum output, while the third LED chip moves to a third LED medium range output. An upper middle voltage range produces decreasing intensity of the first chip, decreasing intensity of the second chip and increasing intensity of the third chip. A voltage maximum produces a first LED upper range shut off output of the first LED chip, a second LED upper range shut off output from the second LED chip, and a third LED upper range maximum output from the third LED chip.

The call out list of elements is a useful guide in referencing the elements of the drawings. For ease of reference, a call out list of elements is provided below.

21 Minimum Voltage
22 Lower Middle Voltage Range
23 Middle Voltage Range
24 Upper Middle Voltage Range
25 Voltage Maximum
31 First Led Maximum Output
32 First Led Lower Output
33 First Led Upper Range Shut Off Output
34 Second Led Lower Range Shut Off Output
35 Second Led Midrange Maximum Output
36 Second Led Upper Range Shut Off Output
37 Third Led Lower Range Shut Off
38 Third Led Medium Range Output
39 Third Led Upper Range Maximum Output
41 First Led Chip
42 Second Led Chip
43 Third Led Chip
51 Permanent Magnet
52 Coil
53 Voltage High Of Coil
54 Voltage Low Of Coil
61 Multiple Chips
62 Led Chip Package
63 Lens
64 Body
65 First Lead
66 Second Lead
67 Integrated Chip Package Microcontroller
69 First Contact
68 Second Contact
71 Groove Lens Hollow
72 Groove Lens Body
73 Groove Lens Sidewall

74 Groove Lens Protrusion
75 Rotor
76 Catch Groove
77 Led Bulb Mounting Hole
78 Groove of Rotor
79 Insertion Force
81 Ends Of Axle
82 Outer Housing Groove
88 Outer Housing Of Gyroscopic Wrist Exerciser

DETAILED DESCRIPTION OF THE PREFERRED EMBODIMENTS

Figure 5:
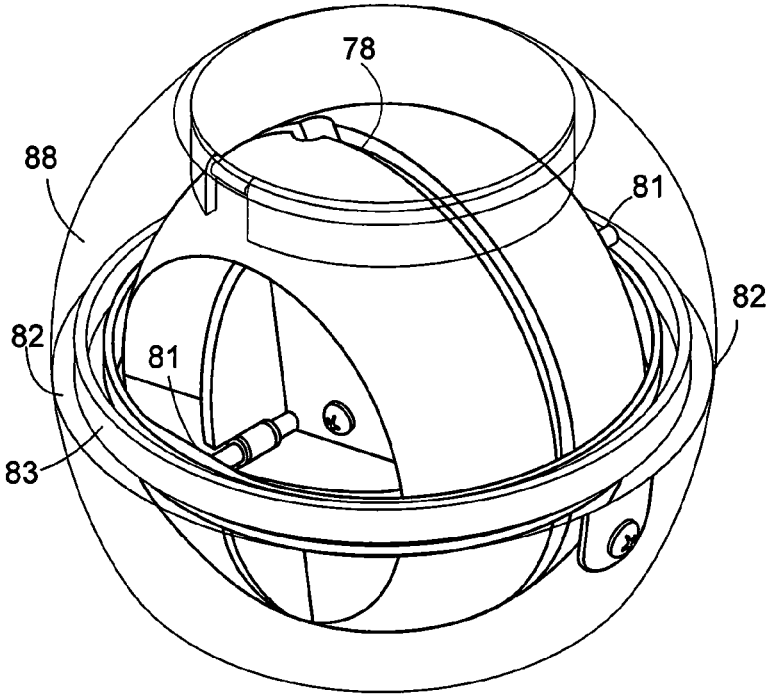
FIG. 5 is a perspective view of the entire device.
Figure 6:
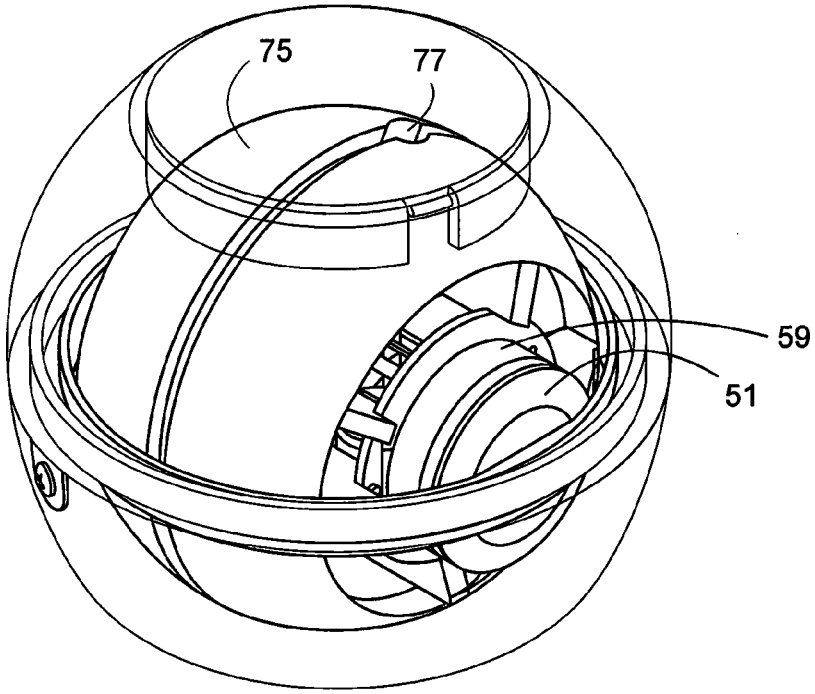
FIG. 6 is another perspective view of the entire device.

The gyroscopic wrist exerciser has an outer housing 88 having ends of axle 81 set into an outer housing groove 82 which is a circumferential groove. FIGS. 5, 6 show the outer housing as transparent. Within an outer housing 88, in number of components are mounted inside. Most immediately the mounting ring receives ends of axle 81, and the mounting ring 83 is mounted within the circumferential groove of the outer housing groove 82 so as to maintain ends of axle 81 within the circumferential groove.

A gyroscopic wrist exerciser includes a color changing LED system integrated into a plastic head. As the gyroscopic wrist exerciser rotor increases in speed, the gyroscopic wrist exerciser outputs more voltage to the LED circuit. The LED circuit senses the increasing voltage and activates a series of LEDs in proportion to the voltage output. The LED circuit a have three LEDs mounted on a printed circuit board in conjunction with an LED controller.

A rainbow color transition can be produced by three LEDs. For example, at low voltage, the LED circuit could activate a red LED. Then at a medium voltage the LED could activate a green LED and then the LED circuit could activate a blue LED. The light color would start as red at low rpm range and then with increased RPM the light output can become yellow when the red LED and the green LED are both on. When the medium rpm range is reached a green LED can be output. With further increasing speed, the green LED would mix with the blue LED so that the output would become cyan. As a high range is reached, the green LED would decrease in intensity so that only the blue LED is active.

Other modifications of this can be a red LED at low rpm which does not shut off, but is complemented by a green LED at medium rpm and a blue LED at high rpm. This would start with a red color which would transition to a yellow color and then end with a white color when all three LEDs are active. The three LEDs can be mounted within a single LED bulb. Alternatively, three separate bulbs with three separate LED chips can be utilized.

The microcontroller for the three LEDs can be miniaturized and built into the LED bulbs, or the microcontroller can be mounted to a printed circuit board which also receives the three LEDs. In operation, the color of the LED provides a visual indicator as to the speed of the rotor. An integrated circuit such as a PIC12F675 can control the various intensities of outputs of a single rainbow RGB LED bulb that has three LED chips. The integrated circuit is can be programmed in C+ or can also be programmed in basic. David Prutchi of Impulse Dynamics in Haifa Israel presents in the Dec. 7, 2004 issue of EDN magazine, a Rainbow LED that indicates voltage with color change using a PIC12F675 microprocessor and a multicolor LED bulb. The microcontroller can be miniaturized and incorporated into the head of the multicolor LED bulb. A variety of LED bulbs have a built-in microcontroller to provide automatic color cycling. These color cycling LED bulbs have an integrated multicolor SMD chip and controller chip embedded in a standard T1-3/4 package. A standard T1-3/4 package is not much larger than a regular LED bulb. Although the microcontroller can be made as a programmable microprocessor having a large power requirement when the rotor is heavy and larger than handheld sized, the microcontroller can also be made as a passive integrated circuit formed as a package and integrated into a standard T1-3/4 package.

Figure 1:
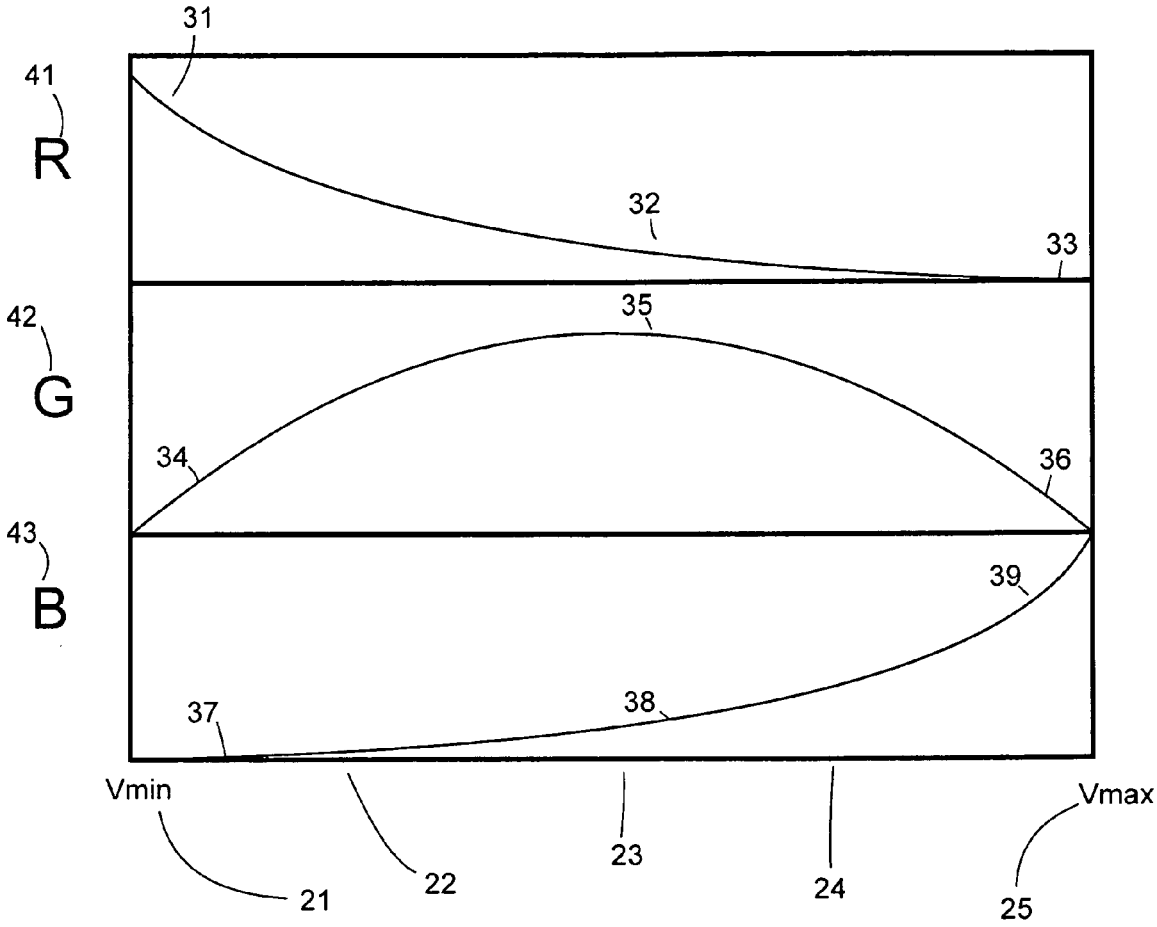
FIG. 1 is a diagram of the RGB light intensity over voltage.

The analog input and output can be shown in FIG. 1 as a differential voltage configuration chart having RGB functionality denoting the three basic colors. The chart shows light intensity on a vertical axis and shows voltage on a horizontal axis. The first chip 41 activates at a minimum voltage 21 producing a first LED maximum output 31. The second LED chip 42 begins at a second LED lower range shut off output when at voltage minimum 21. The third LED chip 43 begins at a third LED lower range shut off of no light intensity. The lower middle voltage range 22 provides a drop in intensity of the first chip or bulb, and increasing the intensity of the second chip or bulb and a minor increase in the intensity of the third chip or bulb. The voltage minimum 21 has a color red which shifts to yellow and the lower middle voltage range 22.

The middle voltage range 23 produces a mostly green color with minor input from the red chip 41 and the blue chip 43. The middle voltage range 23 produces a first LED lower output 32 at the first chip 41. The first chip 41 then proceeds to the first LED lower output 32 which is dimmer. The second LED chip 42 proceeds to a second LED midrange maximum output 35, while the third LED chip 43 moves to a third LED medium range output 38.

As the speed of the rotor increases, the voltage also from the middle voltage range 23 to the upper middle voltage range 24 which corresponds to a cyan color. The upper middle voltage range 24 produces decreasing intensity of the first chip, decreasing intensity of the second chip and increasing intensity of the third chip 43. The voltage maximum 25 at a maximum or near maximum rotational velocity of the rotor produces a first LED upper range shut off output 33 from the first chip 41. The voltage maximum 25 at a maximum or near maximum rotational velocity of the rotor produces a second LED upper range shut off output 36 from the second LED chip 42. The voltage maximum 25 at a maximum or near maximum rotational velocity of the rotor produces a third LED upper range maximum output 39 from the third LED chip 43.

Figure 2:
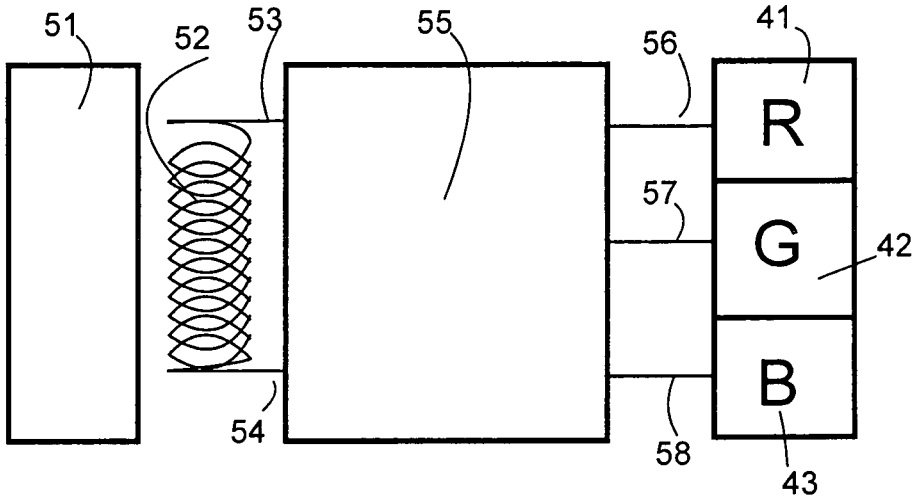
FIG. 2 is a block diagram of the light generation module.
Figure 3:
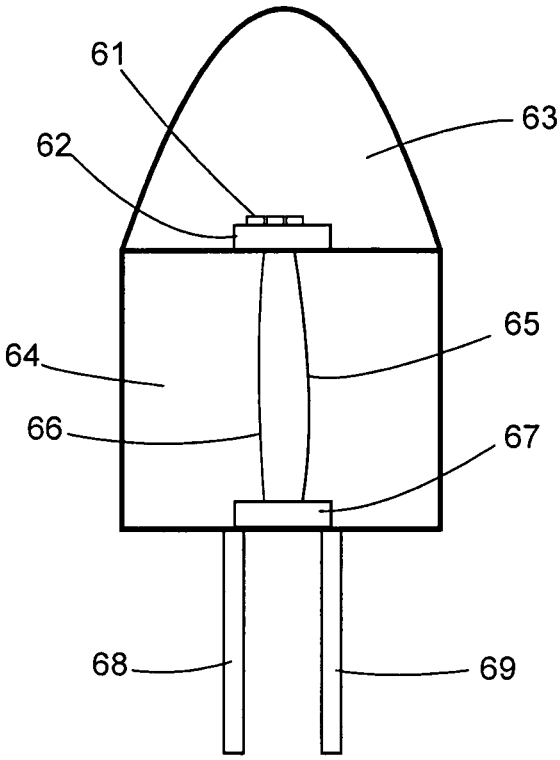
FIG. 3 is an LED bulb of the present invention.
Figure 4:
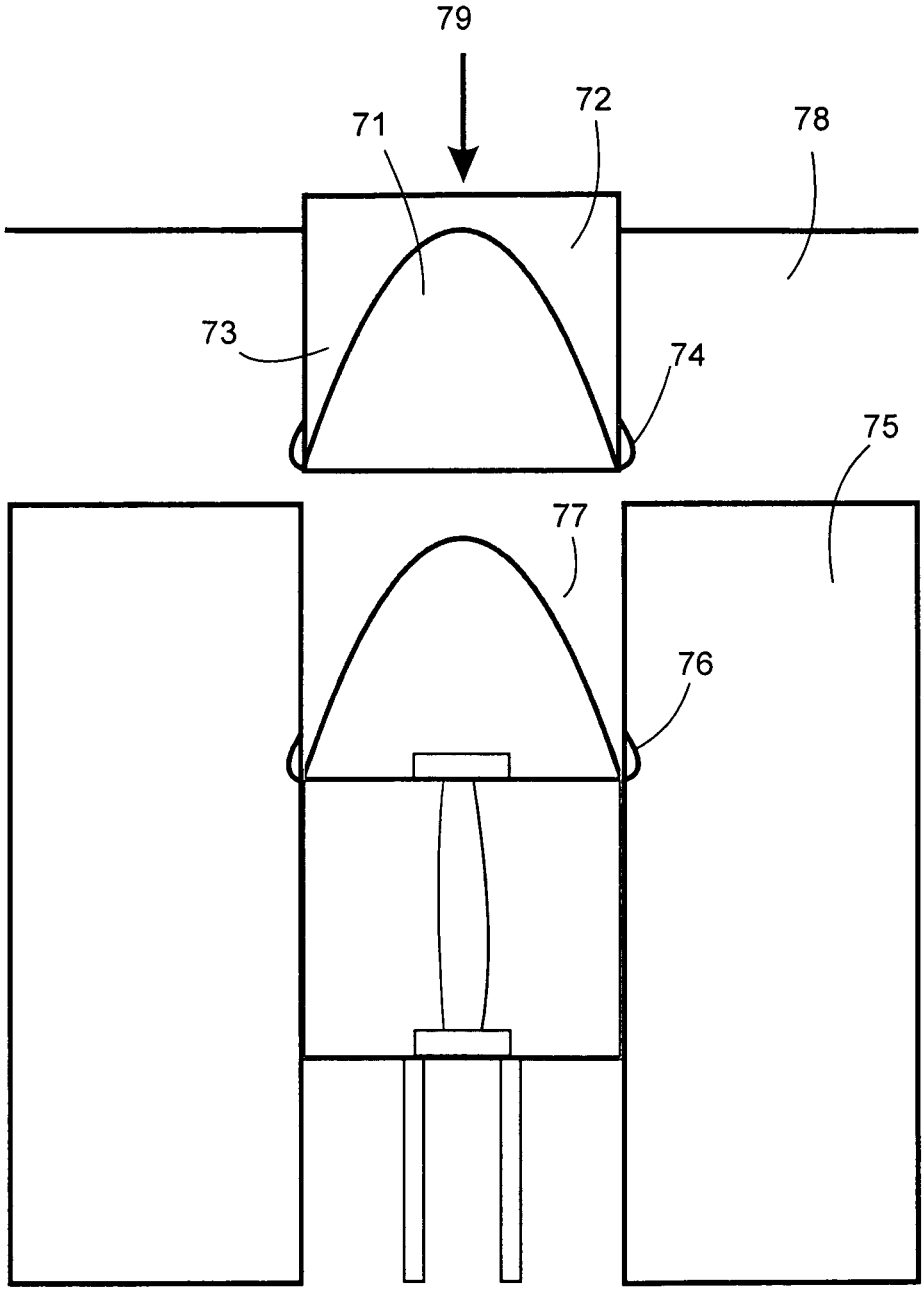
FIG. 4 is a cross-section diagram showing mounting of the bulb into the groove of the rotor.

A block diagram of the present invention can be shown FIG. 2 where the permanent magnet 51 is mounted on the housing of the gyroscopic wrist exerciser. The coil 52 provides a voltage high 53 and voltage low 54 of the coil, which are connected to an integrated circuit 55. The integrated circuit 55 provides a first output 56 to the first LED chip 41, provides a second output 57 to the second LED chip 42, and provides a third output 58 to the third LED chip 43. The integrated circuit can also be made as a passive circuit and an integrated circuit rather than a programmable microprocessor which requires a large power supply. The integrated circuit can be formed in a package integrated to the bulb of the LED. The permanent magnet 51 preferably has a protective cover 59 mounted over the permanent magnet.

The preferred physical construction of the bulb LED is to have multiple chips 61 on a chip package 62 encased in a lens formed as a bulb. The first lead 65 makes electrical connection between the chip package 62 and in the integrated chip package 67. The second lead 66 also makes electrical connection between the LED chip package 62 and the integrated chip package 67. The third lead also makes electrical connection between the LED chip package and integrated chip package.

Both the integrated chip package 67 and the LED chip package 62 are encased in the lens 63 or the body 64 which is a hard plastic encapsulating the LED chip package and the integrated chip package 67. The integrated chip package is electrically connected to a pair of prong contacts, namely a first contact 69 and the second contact 68.

The LED bulb is mounted in an LED bulb mounting hole 77. The mounting hole includes a circumferential catch groove 76 cut into the rotor 75. The rotor 75 is preferably made of transparent material. The mounting hole 77 receives a groove lens body 72 which forms a groove lens hollow 71 approximately matching the top profile of the LED bulb. The circumference of the groove lens sidewall 73 is also preferably round to fit into the round LED bulb mounting hole 77. The groove lens fits as a cap over the LED bulb to obtain control over the light dispersal and also to protect the LED bulb. The catch groove 76 receives a circumferential groove lens protrusion 74 which protrudes around the round periphery of the groove lens sidewall 73. The rotor 75 is formed with the groove 78 which is used for receiving a driving wheel for starting the rotor. The groove 78 passes around the circumference of the rotor. The groove lens body 72 and the rotor 75 are both clear. In an alternate embodiment, the groove lens body 72 can be formed with the rotor 75. An insertion force from a finger or a tool can be used for pressing the groove lens into the LED bulb mounting hole 77. The housing of the gyroscopic wrist exerciser is also preferably clear.

The changing lights can be used for designating a workout routine. The workout routine can be on a DVD for instructing a variety of routines. In a step routine, the user can be instructed to operate the gyroscopic wrist exerciser at a low speed for two minutes, then operate the gyroscopic wrist exerciser at a medium speed for two minutes and then operate the gyroscopic wrist exerciser at high speed for two minutes. The user could be instructed to operate the gyroscopic wrist exerciser at the green zone for two minutes, then operate the gyroscopic wrist exerciser at the blue zone for two minutes, and then operate the gyroscopic wrist exerciser at the red zone for two minutes.

The LED color change can be a set pattern and cumulative over time rather than speed dependent. In the timer embodiment of the microcontroller, the microcontroller has a set pattern of light generation, such as beginning with the red, then changing to blue than changing to green so that as long as the gyroscopic wrist exerciser is operating, the LED color change will be occurring. The LED color change microcontroller is preferably embedded within the bulb of the LED. The set pattern could be a flashing pattern through each of the red blue and green colors for several seconds. Thus set pattern could also be slower such as mixing a variety of the different colors as stated above. The LED color change of the set pattern would be triggered by presence of a voltage supply rather than a particular amount of voltage.

The LED color change can also be random so that a variety of different colors are produced at random. The microcontroller would be programmed to provide a variety of different colors produced at random. The microcontroller responsible for random color production is preferably embedded within the bulb of the LED.

The foregoing describes the preferred embodiments of the invention. Modifications may be made without departing from the spirit and scope of the invention as set forth in the following claims. The present invention is not limited to the embodiments described above, but encompasses any and all embodiments within the scope of the following claims.

The invention claimed is:

1. A gyroscopic wrist exerciser having a transparent plastic housing and a gyroscopic rotor mounted on an axle rotating on a primary axis of rotation about the axle, wherein ends of the axle are extended into a circumferential housing groove disposed on an inside surface of the transparent plastic housing, wherein the ends of the axle rotate in a secondary axis of rotation about the circumferential groove to provide precession of the gyroscopic rotor, wherein the gyroscopic wrist exerciser is configured for color changing and comprises:

a. a permanent magnet cooperating with a coil to produce an electric current, wherein the electric current is proportional to the speed of the rotor;

b. a microcontroller connected to and powered by the coil, wherein the microcontroller has three separate outputs, namely a first output, a second output and a third output which receive degrees of voltage depending upon an input voltage from the coil;

c. a first LED chip connected to the microcontroller at the first output;

d. a second LED chip connected to the microcontroller at the second output;

e. a third LED chip connected to the microcontroller at the third output, wherein the microcontroller is configured to produce a varied output depending upon the input voltage from the coil:

f. wherein at a minimum voltage the first chip activates producing a first LED maximum output, wherein the second LED chip begins at a second LED lower range shut off output, wherein the third LED chip begins at a third LED lower range shut off of no light intensity;

g. wherein an increase of rotational speed and voltage to a lower middle voltage range provides a drop in intensity of the first LED chip, and increasing the intensity of the second LED chip and a minor increase in the intensity of the third LED chip;

h. wherein a middle voltage range produces a first LED lower output at the first LED chip, wherein the second LED chip proceeds to a second LED midrange maximum output, while the third LED chip moves to a third LED medium range output;

i. wherein an upper middle voltage range produces decreasing intensity of the first chip, decreasing intensity of the second chip and increasing intensity of the third chip; and j. wherein a voltage maximum produces a first LED upper range shut off output of the first LED chip, a second LED upper range shut off output from the second LED chip, and a third LED upper range maximum output from the third LED chip.

2. The gyroscopic wrist exerciser of claim 1, further comprising a rotor groove formed as a circumferential groove around an external periphery of the rotor, wherein the rotor groove further comprises an LED bulb mounting hole.

3. The gyroscopic wrist exerciser of claim 2, further comprising an LED bulb mounted within the LED bulb mounting hole, wherein the LED bulb includes the first LED chip, the second LED chip and the third LED chip encapsulated within the LED bulb.

4. The gyroscopic wrist exerciser of claim 3, wherein the first LED chip, the second LED chip and the third LED are formed in an LED chip package which is encapsulated within the LED bulb.

5. The gyroscopic wrist exerciser of claim 4, wherein the microcontroller is encapsulated within the LED bulb.

6. The gyroscopic wrist exerciser of claim 5, further comprising a groove lens having a groove lens body and a groove lens sidewall, wherein the groove lens caps the LED bulb mounting hole to present a substantially flush outer surface.

7. The gyroscopic wrist exerciser of claim 5, further comprising a protective cover mounted over the permanent magnet.

8. The gyroscopic wrist exerciser of claim 1, wherein the first LED chip, the second LED chip and the third LED are formed in an LED chip package which is encapsulated within the LED bulb.

9. The gyroscopic wrist exerciser of claim 1, further comprising an LED bulb mounted within the LED bulb mounting hole, wherein the microcontroller is encapsulated within the LED bulb.

10. The gyroscopic wrist exerciser of claim 1, further comprising an LED bulb mounted within the LED bulb mounting hole, further comprising a groove lens having a groove lens body and a groove lens sidewall, wherein the groove lens caps the LED bulb mounting hole to present a substantially flush outer surface.

11. The gyroscopic wrist exerciser of claim 5, further comprising a protective cover mounted over the permanent magnet.

* * * * *